United States Patent [19]

Larsen

[11] 4,114,394

[45] Sep. 19, 1978

[54] APPARATUS FOR PREVENTING EROSION OF THE SEABED IN FRONT OF HYDRAULIC STRUCTURES

[76] Inventor: Ole Fjord Larsen, 62 Fasanvaenget P. O. Box 604, DK 6700 Esbjerg, Denmark

[21] Appl. No.: 775,606

[22] Filed: Mar. 8, 1977

Related U.S. Application Data

[63] Continuation of Ser. No. 604,836, Aug. 14, 1975, abandoned.

[51] Int. Cl.[2] ..... E02B 3/04

[52] U.S. Cl. ..... 405/25; 405/211

[58] Field of Search ..... 61/102, 2, 3, 4, 1 R, 61/37, 38

[56] References Cited

U.S. PATENT DOCUMENTS

| | | | |
|---|---|---|---|
| 2,390,403 | 12/1945 | Van Der Rest | 61/38 |
| 2,870,609 | 1/1959 | Siebenmansen, Jr. et al. | 61/24 |
| 3,529,427 | 9/1970 | Titman | 61/102 |
| 3,830,066 | 8/1974 | Larsen | 61/3 |
| 3,844,123 | 10/1974 | Larsen | 61/3 |

*Primary Examiner*—Mervin Stein
*Assistant Examiner*—Alex Grosz

[57] ABSTRACT

The combination of a marine structure having a foot disposed in the bed of a body of water and first means for reducing and preventing scours of the bed at the foot of the marine structure with the foot in place, second means mounting the first means for general vertical sliding movement along the foot, the first means having opposite first and second end portions, the first end portion being more remotely spaced from the foot than the second end portion in a first in-place operative position of the first means, and the second means mount the second end portions of the first means for the latter sliding movement.

20 Claims, 8 Drawing Figures

APPARATUS FOR PREVENTING EROSION OF THE SEABED IN FRONT OF HYDRAULIC STRUCTURES

This is a continuation application of application Ser. No. 604,836 filed Aug. 14, 1975, now abandoned in the name of Ole Fjord Larsen for Apparatus for Preventing Erosion of The Seaben in Front of Hydraulic Structures, the latter-noted application now being abandoned.

The present invention relates to a device for preventing erosion of the seabed at the lower end of such marine structures as bridge piers, legs of platforms, lighthouses, mast foundations, sheet piling walls, etc.

When the tidal, littoral or orbital current meets marine structures of the type mentioned, there is a tendency for the water to pile up with a consequent downward flow along a vertical face of the structure which upon meeting the seabed creates a vortex at the upstream face of the marine structure. Due to the current, this vortex spreads and creates a horseshoe-formed vortex and/or a cone-formed hole around the marine structure which obviously tends to render the same unstable.

Heretofore in order to stabilize and prevent such undermining of marine structures gravel and stones traditionally have been dumped into such holes which are termed scour holes. However, secondary scouring is caused by the dumped material and undermining of the seabed continues such that the dumped material continues to sink into the seabed necessitating repeated expensive dumpings.

In lieu of dumping material in the manner described a device consisting of an open network has been used in association with a marine structure adjacent the seabed but reduction of scouring has been of limited efficiency because the open network does not stop the downward flow along the face of the structure.

In keeping with the present invention a novel device is provided which includes first means for reducing and preventing scours of the bed at the foot a marine structure, second means mounting the first means for general vertical sliding movement along the foot of the marine structure, the first means having opposite first and second end portions, the first end portion being more remotely spaced from the foot than the second end portion in a first in-placed operative position of the first means, and the second means mounting the second end portion of the first means for the latter-noted sliding movement.

A further object of this invention is to provide a novel device of the type aforesaid wherein the first means is positionable at a second position at which the first and second end portions are both adjacent the foot, cable means are provided for controlling gravity-influence sliding movement of the first means, and the first means are defined by a plurality of separate sections individually slidably movable along the foot.

Yet another object of this invention is to provide a novel device of the type aforesaid including third means for expanding and contracting the first means to respectively increase and decrease the distance between the first and second end portions, the first means being a lattice girder of a generally triangular outline having an apex defining the first end portion and a base remote from the apex defining the second end portion, and the apex points in a direction away from the foot in the first in-place position and in a downward direction in the second position.

Still another object of this invention is to provide a novel device of the type aforesaid wherein the first means is hinged medially of the first and second end portions and the second means is defined in part by a longitudinal recess in the marine structure for effecting the general vertical sliding movement.

With the above and other objects in view that will hereinafter appear, the nature of the invention will be more clearly understood by reference to the following detailed description, the appended claims and the several views illustrated in the accompanying drawings.

IN THE DRAWINGS

Figures 1, 2, 3, 4, 5, 6, 7, 8:
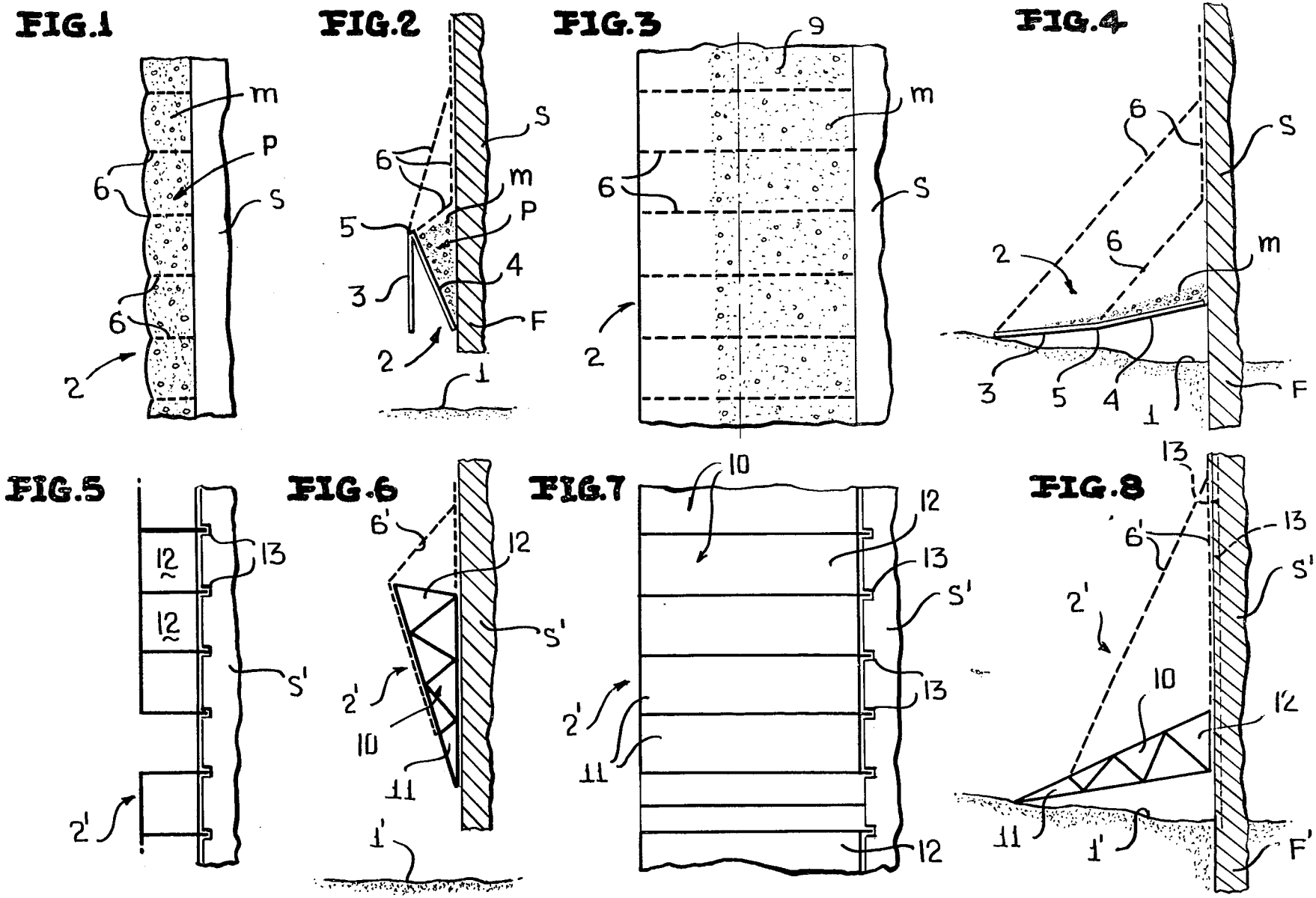
FIG. 1 is a fragmentary, schematic, top plan view of a device of this invention, and illustrates a sheet or sack housing film material secured to a marine structure with the sheet being in its inoperative position.
FIG. 2 is a fragmentary, schematic, vertical sectional view of FIG. 1, and illustrates the marine structure prior to being seated within the seabed.
FIG. 3 is a fragmentary, schematic, top plan view similar to FIG. 1, and illustrates the sheet in its in-place operative position.
FIG. 4 is a fragmentary, schematic, vertical sectional view similar to FIG. 2, and illustrates the marine structure imbedded in the seabed and the device in its in-place operative position protecting the marine structure against scouring.
FIG. 5 is a fragmentary, schematic, top plan view of another device constructed in accordance with this invention, and illustrates a plurality of vertically slidable anti-scouring means associated with a marine structure.
FIG. 6 is a fragmentary, schematic, vertical sectional view of the device of FIG. 5, and illustrates the means in the form of a girder having opposite base and apex portions with the apex portion being directed downwardly in the inoperative position of the device.
FIG. 7 is a fragmentary, schematic, top plan view similar to FIG. 5, and illustrates the anti-scouring girder or platform in its operative position.
FIG. 8 is a fragmentary, schematic, vertical sectional view, and more clearly illustrates the operative position of the anti-scouring device with the base portion thereof adjacent the marine structure and the apex portion remote therefrom.

References first made to FIGS. 1 and 2 of the drawings which illustrate a seabed 1 in which is imbedded a foot F of a marine structure S in the manner illustrated in FIG. 4. The means generally designated by the reference numeral 2 are provided for reducing and preventing scouring of the seabed 1 at the foot F of the marine structure S when the means 2 is in its first or end-place operative position (FIG. 4). The means 2 include a first end portion 3 and a second end portion 4 hingedly connected to each other by conventional hinge means 5 with the first portion 4 being more closely adjacent the foot F of the marine structure S than the end portion 3. Thus, the marine structure S with the first end portion 4 of the means 2 defines a pocket P in the second or inoperative position (FIGS. 1 and 2) in which gravel or like material M is deposited. A plurality of cables 6 are suitably connected to the end portions 3, 4 in order that upon the marine structure M being imbedded in the seabed 1 (FIG. 4), the cables 6 can be operated such that the gravity effect of the material M will relatively unfold the end portions 3, 4 from the position shown in FIG. 2 to the operative position shown in FIG. 4.

Reference is now made to FIGS. 5 through 8 of the drawings where like structure bears identical numerals to those appearing in FIGS. 1 through 4 and have been accordingly primed. The device 2′ of FIGS. 5 through 8 is in the form of a lattice-like girder 10 or a plurality of such lattice-like girders 10 (FIGS. 5 and 7) each having an apex portion 11 and a base portion 12. The apex portion 11 is directed generally vertically downwardly in the inoperative position (FIG. 6) of the device and is also directed outwardly away and remote from the marine structure S′ in the in-place operative position (FIGS. 7 and 8). The base portion 12 is connected by means 13 in the form of vertical channels or slots to allow each of the girders 10 to be mounted for vertical sliding movement relative to the marine structure S′ in the manner readily apparent from FIGS. 5 through 8 of the drawings. Thus, by utilizing a suitable number of cables 6′ which are attached to the base portion 12 and between the apex portion 11 and the base portion 12 the various lattice-like girders 10 can be moved between the positions best shown in FIGS. 6 and 8.

The devices 2, 2′ are particularly adapted for installation on movable marine structures such as oil drilling rigs and thus are either folded compactly (FIGS. 1 and 2) or slid to an inoperative position (FIGS. 5 and 6) such that installation in the positions shown in FIGS. 1, 2, 5, and 6 may be made on shore prior to in-place use (FIGS. 3, 4, 7 and 8). Due to the vertical sliding nature of the device 2′ relative to the marine structure S′, the same may be shifted vertically in the in-use position as may be found necessary or desirable depending upon conditions.

In each of the devices of FIGS. 1 through 8, a flexible sheet (not shown) may overlie the portions 3, 4 and the upper surface (unnumbered) of the girder 10. Moreover, the individual lattice-like girders 10 are preferably operated individually so that should seabed 1′ be of an irregular or undulating configuration, the various lattice-like girders 10 can be positioned as necessary. Additionally, in lieu of the hinge 5, the portions 3, 4 may be telescoped relative to each other or otherwise constructed so that the overall length of device 2 as well as the device 2′ can be varied in the end-place division (FIGS. 4 and 8).

The embodiments of the invention in which an exclusive property or privilege is claimed are define as follows:

1. The combination of a marine structure having a foot disposed in the bed of a body of water and first means for reducing and preventing scours of the bed at the foot of the marine structure with the foot in place, second means mounting said first means for general vertical sliding movement along said foot, said first means having opposite first and second end portions, said first end portion being more remotely spaced from said foot than said second end portion in a first in-place operative position of said first means, said second means including vertical channel guiding means carried by said foot to which is slidably guidably interconnected said second end portion for guided vertical movement of said second end portion and said first means relative to and along said foot, and cable means connected to said first means for slidably moving said first means relative to and along said vertical guiding means.

2. The combination as defined in claim 1 wherein said first means is positionable at a second position at which said first and second end portions are both adjacent said foot.

3. The combination as defined in claim 2 including first and second cable means secured respectively to said second end portion and between said first and second end portions for controlling gravity-influenced sliding movement of said first means.

4. The combination as defined in claim 3 wherein said first means are defined by a plurality of separate sections individually slidably movable along said foot.

5. The combination as defined in claim 3 wherein third means are provided for expanding and contracting said first means to respectively increase and decrease the distance between said first and second end portions.

6. The combination as defined in claim 3 wherein said first means is a lattice girder of a generally triangular outline having an apex defining said first end portion and a base remote from said apex defining said second end portion.

7. The combination as defined in claim 3 wherein said first means is a lattice girder of a generally triangular outline having an apex defining said first end portion and a base remote from said apex defining said second end portion, and said apex points in a direction away from said foot in said first in-place position.

8. The combination as defined in claim 3 wherein said first means is positionable at a second position at which said first and second end portions are both adjacent said foot, said first means is a lattice girder of a generally triangular outline having an apex defining said first end portion and a base remote from said apex defining said second end portion, and said apex points in a downward direction in said second position.

9. The combination as defined in claim 1 including cable means secured to said second end portion for controlling gravity-influenced sliding movement of said first means.

10. The combination as defined in claim 1 including cable means secured to said first means between said first and second end portions thereof for controlling gravity-influenced sliding movement of said first means.

11. The combination as defined in claim 1 wherein said first means are defined by a plurality of separate sections individually slidably movable along said foot.

12. The combination as defined in claim 1 wherein third means are provided for expanding and contracting said first means to respectively increase and decrease the distance between said first and second end portions.

13. The combination as defined in claim 1 wherein said first means is a lattice girder of a generally triangular outline having an apex defining said first end portion and a base remote from said apex defining said second end portion.

14. The combination as defined in claim 1 wherein said first means is a lattice girder of a generally triangular outline having an apex defining said first end portion and a base remote from said apex defining said second end portion, and said apex points in a direction away from said foot in said first in-place position.

15. The combination as defined in claim 1 wherein said first means is positionable at a second position at which said first and second end portions are both adjacent said foot, said first means is a lattice girder of a generally triangular outline having an apex defining said first end portion and a base remote from said apex defining said second end portion, and said apex points in a downward direction in said second position.

16. The combination as defined in claim 1 wherein said first means is positionable at a second inoperative position at which said first and second end portions are both adjacent said foot and said second end portion is above said first end portion.

17. The combination as defined in claim 16 wherein said first means is a lattice girder of a generally triangular outline having an apex defining said first end portion and a base remote from said apex defining said second end portion, and said apex points in a downward direction in said second inoperative position.

18. The combination as defined in claim 17 including cable means secured at least contiguous to said base for controlling the sliding movement of said first means.

19. The combination as defined in claim 1 wherein said first means is hinged medially of said first and second end portions.

20. The combination as defined in claim 1 wherein said vertical channel guiding means is defined in part by longitudinal recess means in said marine structure foot.

* * * * *